US010683681B2

(12) United States Patent
Rahilly

(10) Patent No.: US 10,683,681 B2
(45) Date of Patent: Jun. 16, 2020

(54) LIDDED MINI-DRAWER ASSEMBLY WITHOUT A CABLE

(71) Applicant: CareFusion 303, Inc., San Diego, CA (US)

(72) Inventor: Michael Rahilly, Encinitas, CA (US)

(73) Assignee: CAREFUSION 303, INC., San Diego, CA (US)

( * ) Notice: Subject to any disclaimer, the term of this patent is extended or adjusted under 35 U.S.C. 154(b) by 177 days.

(21) Appl. No.: 16/013,854

(22) Filed: Jun. 20, 2018

(65) Prior Publication Data

US 2019/0390482 A1 Dec. 26, 2019

(51) Int. Cl.

| | |
|---|---|
| ***E05B 65/46*** | (2017.01) |
| ***A47B 88/919*** | (2017.01) |
| ***A47B 88/457*** | (2017.01) |
| ***E05B 47/00*** | (2006.01) |
| ***E05B 65/00*** | (2006.01) |
| ***G07C 9/00*** | (2020.01) |

(52) U.S. Cl.

CPC ..... *E05B 65/46* (2013.01); *A47B 88/457* (2017.01); *A47B 88/919* (2017.01); *E05B 47/00* (2013.01); *E05B 65/0003* (2013.01); *G07C 9/00174* (2013.01); *E05B 2047/0048* (2013.01)

(58) Field of Classification Search

CPC ..... E05B 65/46; E05B 47/00; E05B 65/0003; E05B 2047/0048; A47B 88/457; A47B 88/919; G07C 9/00174

USPC ..... 700/231–244

See application file for complete search history.

(56) References Cited

U.S. PATENT DOCUMENTS

| | | | | |
|---|---|---|---|---|
| 5,716,114 | A * | 2/1998 | Holmes | E05B 47/0607 312/215 |
| 8,662,606 | B2 * | 3/2014 | Santmyer | G07F 11/62 312/319.7 |
| 8,701,931 | B2 * | 4/2014 | Santmyer | G07F 17/14 221/1 |
| 8,972,051 | B2 * | 3/2015 | Rahilly | E05B 65/46 700/243 |
| 10,544,609 | B2 * | 1/2020 | Rahilly | E05C 3/12 |

(Continued)

OTHER PUBLICATIONS

International Search Report and Written Opinion for Application No. PCT/US2019/037997, dated Sep. 20, 2019, 13 pages.

*Primary Examiner* — Michael Collins

(74) *Attorney, Agent, or Firm* — Morgan, Lewis & Bockius LLP

(57) ABSTRACT

A drawer assembly is described that includes one or more mini-drawer assemblies. A mini-drawer assembly comprises a sliding tab along a rear-to-front axis, a release mechanism coupled to the sliding tab, and a body having a body bottom coupled from the body bottom to the sliding tab. The body may slide over the sliding tab. The mini-drawer assembly may include a plurality of compartments in the body and a plurality of lids that are hingedly coupled to the compartments. Each lid may have a respective fastening element. A plurality of latches may couple to the body such that each latch is coupled to a corresponding compartment. The latch may hold the respective fastening element of the lid. When the body is pulled out along the rear-to-front axis, the release mechanism may engage with the latch to release the respective fastening element and to unlatch the lid of the compartment.

11 Claims, 10 Drawing Sheets

(56) References Cited

U.S. PATENT DOCUMENTS

| | | | | |
|---|---|---|---|---|
| 2009/0224638 | A1* | 9/2009 | Weber | A47B 67/02<br>312/209 |
| 2012/0187143 | A1* | 7/2012 | Weber | B65D 43/164<br>221/112 |
| 2014/0167574 | A1* | 6/2014 | Shoenfeld | A47B 81/00<br>312/215 |
| 2019/0390482 | A1* | 12/2019 | Rahilly | E05B 47/00 |

* cited by examiner

LIDDED MINI-DRAWER ASSEMBLY WITHOUT A CABLE

FIELD OF THE INVENTION

The present invention generally relates to drawers and, in particular, relates to drawers having individually actuated lidded compartments.

BACKGROUND

Medications are carefully controlled in hospitals and other healthcare facilities. Many facilities use automated dispensing cabinets to provide controlled access to medications. Certain automated dispensing cabinets may provide a number of drawers where each drawer includes a number of compartments. An automated dispensing cabinet may give access to only a single dose of a medication at a time. By unlocking a single drawer and allowing the unlocked drawer to be pulled out to a limit, a user of the automated dispensing cabinet, e.g., a caregiver, may only access a single dose of the medication.

SUMMARY

In some embodiments, a control system of an automated dispensing cabinet can control giving access to compartments of the drawer of the automated dispensing cabinet. Each drawer may contain a single medication and a single dose of the medication may be placed in each one of the multiple compartments of the drawer. The control system may store the information including the type of medication placed in each compartment in a memory of the control system. When a caregiver requests a dose of the medication, the control system may unlock the drawer and may allow the drawer to be opened until a first compartment of the drawer is exposed. Then, the caregiver removes the medication from the first compartment and closes the drawer, and the information of the stored items in the memory of the control system is updated. When another caregiver requests a dose of the same medication, the control system may unlock the drawer and allows the drawer to open until a second compartment is exposed, as the control system previously received the information that the first compartment is now empty. The caregiver removes the dose from the second compartment and closes the drawer and the information of the stored items in the memory of the control system is updated again. The action may be repeated with the control system allowing sequential access to the compartments of the drawer until all of the medications are removed. Thus, granting access to the compartments can be made sequentially. The first compartment at a front of the drawer may be accessed before the second compartment that is one compartment away from the front of the drawer. In some examples, because access to the compartments of each drawer is granted sequentially, a same medication may be stored in each drawer in order of expiration dates, such that a medication with the earliest expiration date may be stored in the first compartment. It is desirable to have compartments that may be individually accessed without exposing other compartments even when a drawer is completely pulled out. It is highly desirable to alleviate the limitation of having a same medication in each drawer or to ease the limitation of arranging the medications of each drawer according to expiration dates.

Currently available drawers of the type described above, control the distance that a sliding drawer is allowed to open using a solenoid-driven latch that is mounted within the sliding drawer. The solenoid-driven latch may engage a ladder that is fixed to a drawer chassis that is mounted in the automated dispensing cabinet. Such a system is disclosed in U.S. Pat. No. 5,716,114 to Holmes and Williamson and U.S. Pat. No. 6,109,774 to Holmes and Broadfield. The solenoid-driven latch may be connected to the processor through a flexible electrical cable, such as a flat ribbon cable formed from multiple conductors laminated between layers of polyimide. The flexible electrical cable flexes between the sliding drawer and the fixed chassis each time the drawer is opened and/or closed. The conventional drawers may suffer because of a breakage of the ribbon cables over time. The constant flexing of the ribbon cables in a confined space between the sliding drawer and the fixed chassis may induce stress between the polyimide layers. The stress between the polyimide layers may cause a delamination of the ribbon cables.

In many instances, it may be desirable to grant access to a single dose of a medication in an automated dispensing cabinet. In some embodiments, an automated dispensing cabinet with a plurality of drawer assemblies may be provided. Each drawer assembly of the automated dispensing cabinet may include a plurality of mini-drawer assemblies such that each mini-drawer assembly may comprise a plurality of lidded compartments. To increase access reliability, the automated dispensing cabinet may be controlled by a control system. The control system may allow access to only one designated compartment. The control system may control the mini-drawer assembly such that when the mini-drawer assembly is unlocked and is pulled out, a lid of the designated compartment is unlocked, e.g., unlatched. The disclosed system and method provide this feature. In certain aspects of the disclosed system, each mini-drawer assembly comprises a body and a sliding tab. The sliding tab may be attached to the mini-drawer assembly, while the body that includes the lidded compartments may slide over the sliding tab and may slide out of the drawer assembly to expose the lidded compartments. In some embodiments, electrical components may be installed, e.g., mounted, on the sliding tab such that the body of the mini-drawer assembly may not have an electrical component. Absence of electrical components in the body of the mini-drawer assembly, thereby, eliminates a need for an electrical cable/ribbon to be connected to the body of the mini-drawer assembly. Lack of need for an electrical cable/ribbon that is connected to the body of the mini-drawer assembly, may resolve the above-mentioned breakage issue of the ribbon cables. Thus, a point of failure in current drawer assemblies may be resolved. In addition, lack of need for electrical cables that are coupled to the sliding bodies of the mini-drawer assemblies provides a capability of filling the sliding bodies in a pharmacy. Then, the filled sliding body may be transported to the automated dispensing cabinet and may be installed into a mini-drawer assembly of the automated dispensing cabinet.

According to various aspects of the subject technology, a drawer assembly is described. The drawer assembly includes one or more mini-drawer assemblies. A mini-drawer assembly comprises a body. The body has a body top, a body bottom, a body rear, a body front, and a rear-to-front axis. The mini-drawer assembly includes a sliding tab along the rear-to-front axis such that the body is coupled from the body bottom to the sliding tab and the body may slide over the sliding tab. The mini-drawer assembly also includes a plurality of compartments in the body and a plurality of lids that are hingedly coupled to the plurality of compartments. The lids are coupled on the body top. A lid may cover an opening of a corresponding compartment and the lid may have a respective fastening element. A plurality of latches may couple to the body such that each one of the plurality of latches is coupled to a corresponding compartment. The plurality of latches may hold the respective fastening element of the plurality of lids when in a first position and may release the respective fastening element when in a second position. The mini-drawer assembly may further include a release mechanism that includes an activation lever coupled to the sliding tab. The activation lever may move between a raised position and a depressed position such that the activation lever in the raised position may engage the latch of a compartment when the body is being pulled out along the rear-to-front axis. The engagement may cause the latch to move to the second position to release the respective fastening element and to unlatch the lid of the compartment.

According to various aspects of the subject technology, a method of using an automated dispensing cabinet is described. The method includes receiving a request to retrieve a designated item from the automated dispensing cabinet. The request may be received by a processor of the automated dispensing cabinet and via a user interface of the automated dispensing cabinet. The method includes determining a drawer assembly, a mini-drawer assembly of the drawer assembly, and a compartment of the mini-drawer assembly having the designated item. The determination may be made by the processor and based on the request. The method also includes sending a command by the processor to a control device of the determined mini-drawer assembly to release a lock of determined mini-drawer assembly. Releasing the lock may indicate the determined mini-drawer assembly to be pulled out. The method further includes receiving position information of the determined mini-drawer assembly while being pulled out. Also, the method includes commanding a trigger arm of the determined mini-drawer assembly to move an activation lever of the determined mini-drawer assembly to a raised position, in response to determining based on the position information that the determined compartment is at a location of the activation lever. The method includes unlatching a lid of the determined compartment to provide the designated item inside the determined compartment.

The foregoing has outlined rather broadly the features of the present disclosure in order that the detailed description that follows can be better understood. Additional features and advantages of the disclosure will be described hereinafter, which form the subject of the claims.

BRIEF DESCRIPTION OF THE DRAWINGS

For a more complete understanding of the present disclosure, and the advantages thereof, reference is now made to the following descriptions to be taken in conjunction with the accompanying drawings describing specific aspects of the disclosure, wherein.

DETAILED DESCRIPTION OF THE PREFERRED EMBODIMENTS

Figure 1:
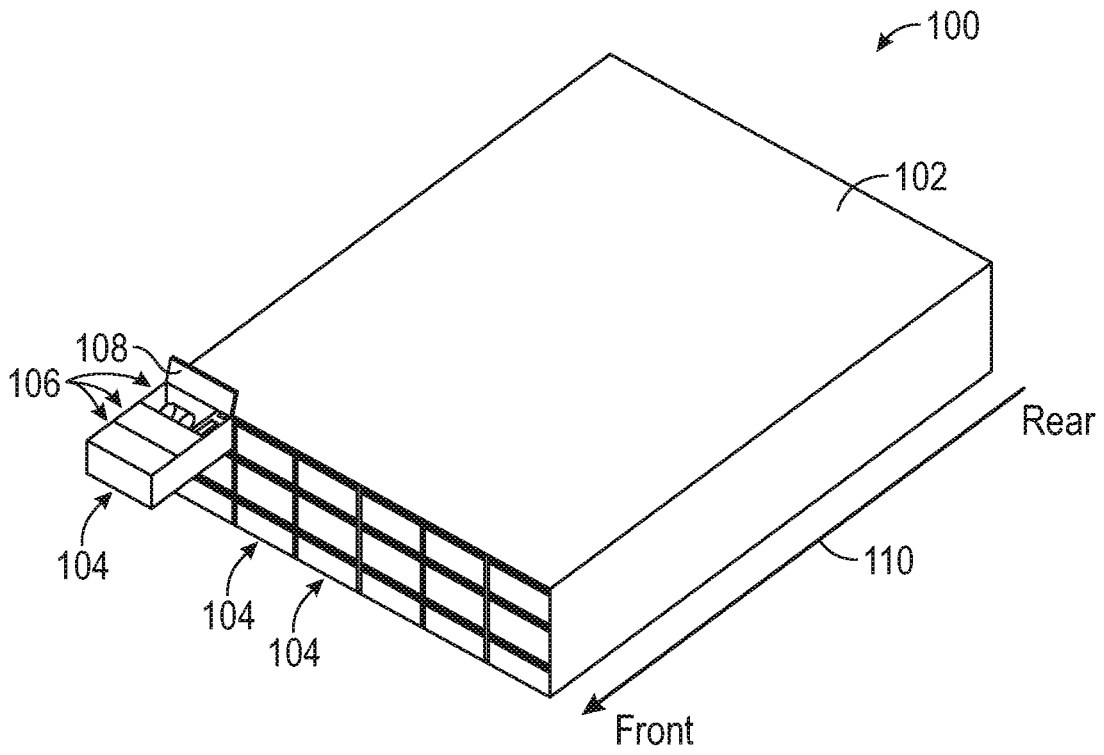
FIG. 1 illustrates an exemplary drawer assembly having multiple mini-drawer assemblies, according to some aspects of the disclosure.

The detailed description set forth below is intended as a description of various configurations of the subject technology and is not intended to represent the only configurations in which the subject technology can be practiced. The appended drawings are incorporated herein and constitute a part of the detailed description. The detailed description includes specific details for the purpose of providing a thorough understanding of the subject technology. However, it will be clear and apparent to those skilled in the art, that the subject technology is not limited to the specific details set forth herein and can be practiced using one or more implementations. In one or more instances, well-known structures and components are shown in block diagram form in order to avoid obscuring the concepts of the subject technology.

According to some implementations, the subject technology provides a drawer assembly for storing items such as medical items and for automatically dispensing the items to a user, such as a caregiver. The drawer assembly can fit into an automated dispensing cabinet. Medications that are expensive or are controlled substances are carefully controlled in hospitals and other healthcare facilities. Many facilities use automated dispensing cabinets, to provide controlled access to such medications without the need for a pharmacist to personally fill every order. Certain automated dispensing cabinets are configured to provide access to only a single dose of a medication at a time. One way of accomplishing this is to provide a drawer having multiple lidded compartments where at a time only a selected number of compartments can be exposed, e.g., opened. The compartments that become exposed may be controlled by a control system.

The drawer may include a plurality of mini-drawer assemblies and each mini-drawer assembly may have a sliding tab that is fixed inside the drawer assembly and a drawer body that can slide on/over the sliding tab. By sliding the drawer body on the sliding tab, the drawer body may be pulled out. The drawer body may include a plurality of compartments that each may have a hinged lid and the lids may be latched, e.g., closed. A control system may control the latches such that when a caregiver requests a dose of a medication, the control system may determine which compartment in a mini-drawer assembly of a drawer assembly should be opened. After opening, e.g., unlatching, the compartment, the requested medication may be provided to the caregiver. After determining the compartment that should be opened (the requested compartment), the control system unlocks the mini-drawer assembly. After mini-drawer assembly is unlocked, the caregiver may pull forward the mini-drawer assembly. While being pulled forward, the requested compartment may pass over an activation lever that is controlled by the control system. The activation lever, if put in a raised position, may cause a lid of the requested compartment to open. The control system may monitor a location of the compartments and when the requested compartment reaches the activation lever, the control system may command the activation lever to move to the raised position. The activation lever being in the raised position may engage with a latch of the requested compartment. Thus, when the requested compartment is pulled out, the lid of the requested compartment may be unlatched and the caregiver may access the content of the requested compartment.

Similarly, a user, e.g., a pharmacist, may request the control system of the automated dispensing cabinet to grant access to a designated compartment to store an item, e.g., a dose of a medication, in the designated compartment. In some examples, the user requests an empty compartment for a specific medication to be stored in the automated dispensing cabinet and the control system may designate the compartment. After storing the medication, the caregiver may update the information of the stored items in the memory of the control system.

FIG. 1 illustrates an exemplary drawer assembly having multiple mini-drawer assemblies, according to some aspects of the disclosure. As shown in FIG. 1, drawer assembly 100 includes a drawer body 102 (e.g., chassis) and a plurality of mini-drawer assemblies 104. FIG. 1 also shows rear-to-front direction 110. Each mini-drawer assembly includes a plurality of lidded compartments 106. Each compartment 106 of mini-drawer assembly 104 may hold an item, e.g., a device or medicine, and may have a separately controllable lid 108 that may be locked (e.g., latched) or unlocked (e.g., unlatched). In some examples, drawer assembly 100 may be used to store different types of items in various compartments 106. In some embodiments, a control device may be included in drawer assembly 100 and may be coupled to each one of the plurality of mini-drawer assemblies 104. In some embodiments, the control device may separately release, e.g., unlock, each mini-drawer assembly 104. Releasing mini-drawer assembly 104 may pop outward mini-drawer assembly 104 to indicate to a caregiver that the mini-drawer assembly may be pulled out. A caregiver may manually pull mini-drawer assembly 104 in the rear-to-front direction 110 when the mini-drawer assembly is released. In some examples, drawer assembly 100 may comprise 1 to 48 mini-drawer assemblies, e.g., 6, or 18 mini-drawer assemblies. The process of using drawer assembly 100 is described with respect to FIG. 9.

Figure 2:
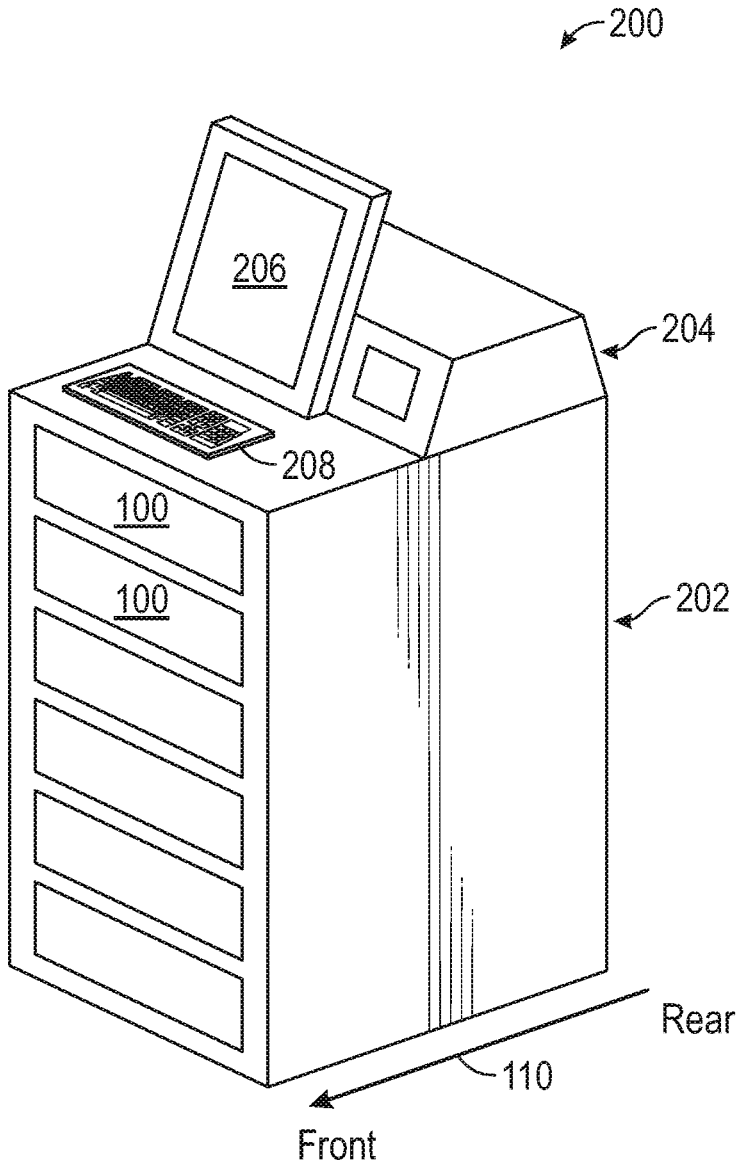
FIG. 2 illustrates an exemplary automated dispensing cabinet having multiple drawer assemblies, according to some aspects of the disclosure.

FIG. 2 illustrates an exemplary automated dispensing cabinet having multiple drawer assemblies, according to some aspects of the disclosure. Automated dispensing cabinet 200 of FIG. 2 may have a cabinet body 202 in which several drawer assemblies 100 as described in FIG. 1 may be installed. Drawer assemblies 100 may extend along rear-to-front direction 110. Automated dispensing cabinet 200 also has top section 204. Top section 204 may comprise user interfaces that include touchscreen display 206, keyboard 208, and a mouse (not shown). As described, each drawer assembly 100 may include a control device to control mini-drawer assemblies 104 of drawer assembly 100.

In some examples, a single control device of automated dispensing cabinet 200 may be coupled to each drawer assembly 100 to control each mini-drawer assembly 104 of each drawer assembly 100. In some embodiments, the single control device of the automated dispensing cabinet or the control devices of each drawer assembly 100 may be coupled via a network interface card and via a wired or wireless network to a server (not shown). Top section 204 also includes a control system. The control system that may be consistent with control system 800 of FIG. 8 includes a processor (not shown in FIG. 2) that accepts input from the user interfaces. The control system may communicate with devices, such as servers, over the network, to control the operation of the various drawer assemblies 100 of automated dispensing cabinet 200. Automated dispensing cabinet are available in a variety of configurations, for example towers, for storage of larger items and portable cabinets for ease of movement of medications and supplies to the point of use. The control system is described in more details with respect to FIG. 8.

In some embodiments, automated dispensing cabinet 200 is a standalone cabinet that houses drawer assemblies. At least one of the drawer assemblies can be a drawer assembly 100. Drawer assembly 100 may include a number of mini-drawer assemblies 104. Each mini-drawer assembly 104 may be pulled out independently of other mini-drawer assemblies 104.

Figure 3A:
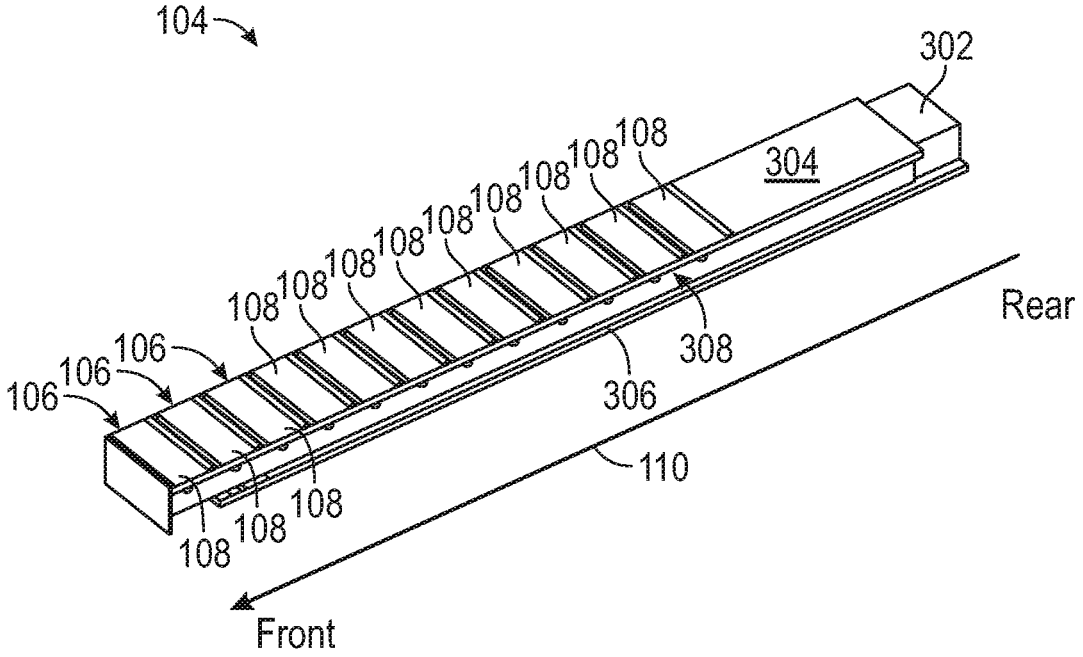
FIGS. 3A-3B illustrate top views of an exemplary mini-drawer assembly, according to some aspects of the disclosure.
Figure 3B:
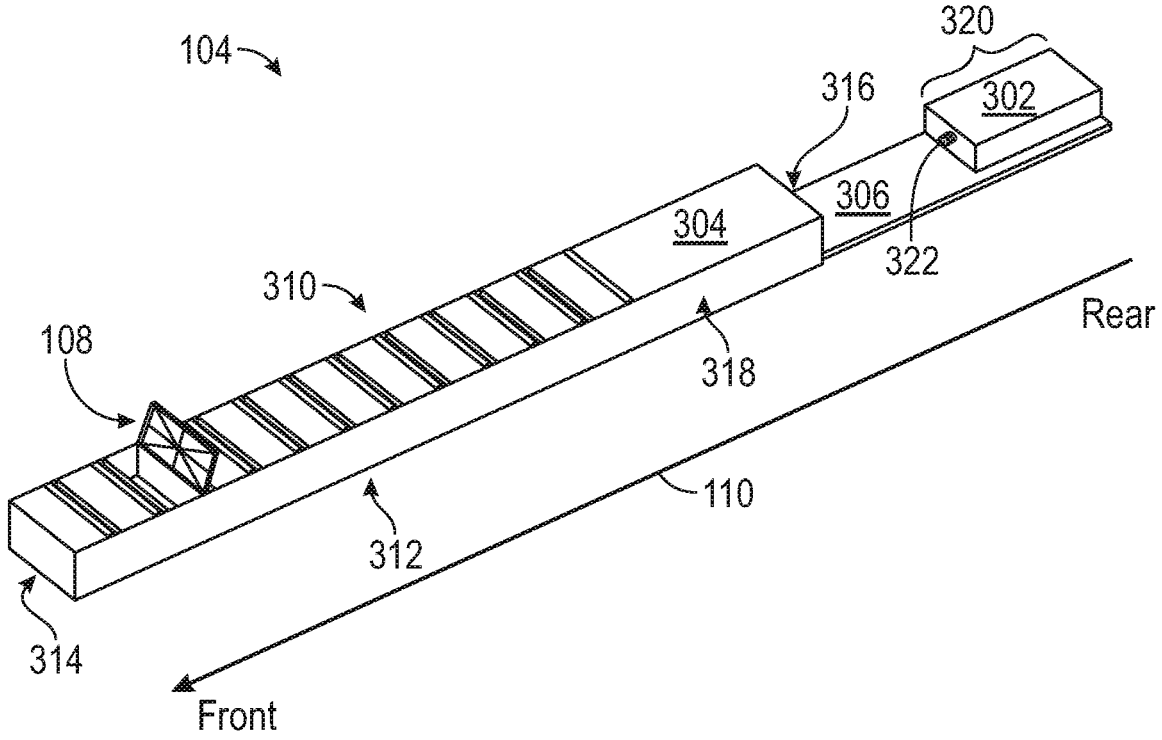

FIGS. 3A-3B illustrate top views of an exemplary mini-drawer assembly, according to some aspects of the disclosure. Mini-drawer assembly 104 may be part of drawer assembly 100 of automated dispensing cabinet 200 of FIG. 2. Mini-drawer assembly 104 of FIGS. 3A-3B may have sliding tab 306 and mini-drawer body 308 such that mini-drawer body 308 may be mounted on sliding tab 306. In some embodiments, mini-drawer assembly 104 is installed inside drawer assembly 100 and extends along rear-to-front direction 110.

Mini-drawer assembly 104 may have a plurality of lidded compartments 106 that may be used for storing items such as medications. Mini-drawer assembly 104 may include control device compartment 302 that is installed at a rear section 320 on sliding tab 306. Mini-drawer assembly 104 may include cushion compartment 304 installed at a rear end of mini-drawer body 308. When mini-drawer body 308 of mini-drawer assembly 104 is pushed all the way back inside drawer assembly 100, cushion compartment 304 may partially cover control device compartment 302 and may prevent or restrict compartments 106 from hitting control device compartment 302. In some embodiments, a spring such as spring 322 of FIG. 3B may be attached to a front face of control device compartment 302 to prevent or restrict compartments 106 from hitting control device compartment 302. In addition, when mini-drawer body 308 of mini-drawer assembly 104 is pushed all the way back inside drawer assembly 100 and mini-drawer assembly 104 is locked, spring 322 may be pressed to store a potential energy. In some examples, when mini-drawer assembly 104 is unlocked, the energy stored in spring 322 may be released and may cause mini-drawer assembly 104 to extend forward.

In some embodiments, sliding tab 306 may be mounted inside drawer assembly 100 such that sliding tab 306 may not move relative to drawer assembly 100. In addition, mini-drawer body 308 may be mounted on sliding tab 306 and may slide along rear-to-front direction 110 on sliding tab 306. In some examples as shown in FIG. 1, mini-drawer body 308 may slide on/over sliding tab 306 to extend out of drawer assembly 100 to expose one or more compartments 106. In some examples, mini-drawer body 308 may slide opposite to rear-to-front direction 110 to be pushed back to the drawer assembly 100. In some examples, mini-drawer assembly 104 is installed in a drawer assembly 100 that is installed in automated dispensing cabinet 200.

In some embodiments as shown in FIG. 3B, mini-drawer body 308 may include body top 310, body bottom 312, body rear 316, and body front 314. A body-covering section such as body-cover 318 of FIG. 3B may cover one or both sides of mini-drawer body 308 and may hide fastening elements such as latches of FIG. 3B on a side of mini-drawer body 308. In some embodiments, lid 108 is hingedly coupled to each compartment 106 on body top 310 of mini-drawer body 308. Additionally, each compartment includes a separate latch that may be coupled to a side of each compartment 106. Each lid 108 may cover an opening of a corresponding compartment 106 and the latches may hold or release the lid to lock and unlock the compartment. The latches are described in more details with respect to FIGS. 5A-5B. As described, body-cover 318 may cover the latches and may prevent or restrict a user from tampering with the latches to open compartments 106.

Figure 4A:
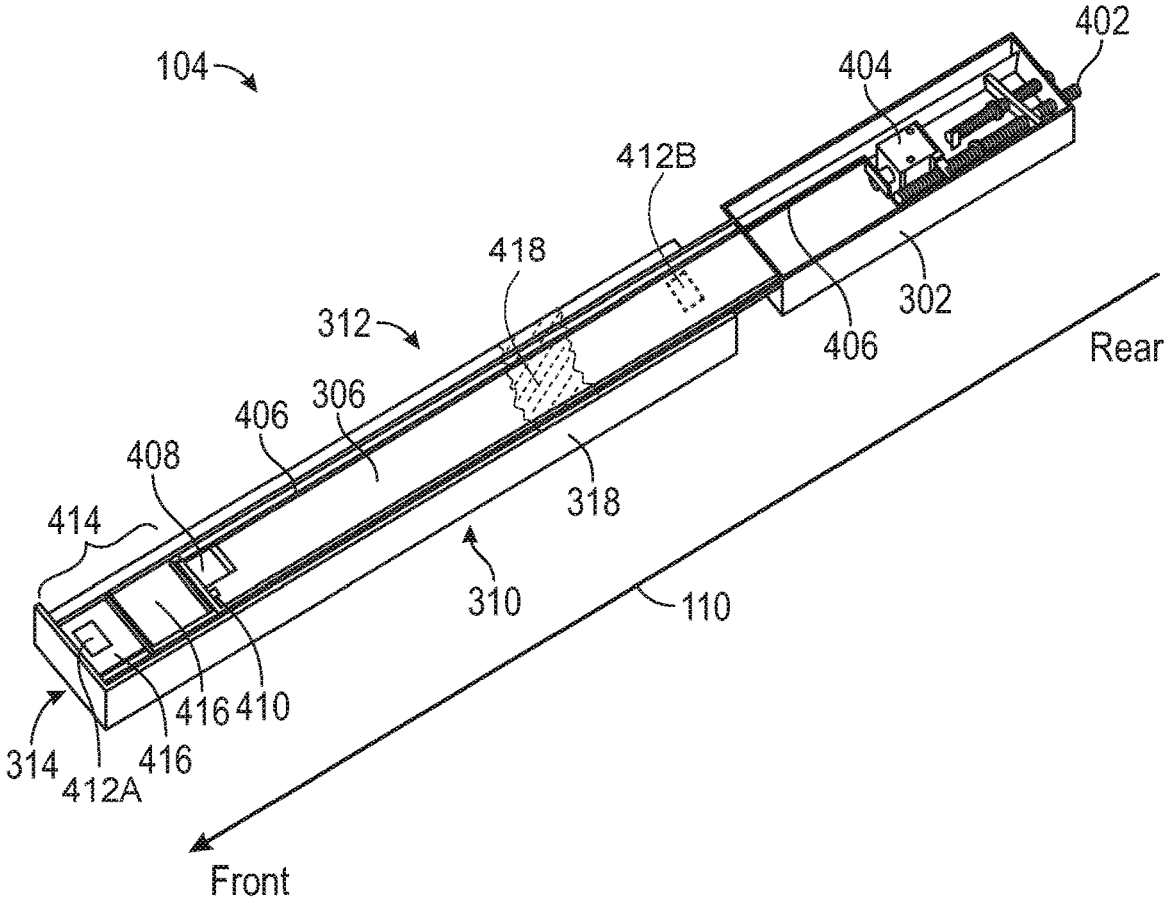
FIG. 4A illustrates a bottom view of an exemplary sliding tab of a mini-drawer assembly, according to some aspects of the disclosure.

FIG. 4A illustrates a bottom view of an exemplary sliding tab of a mini-drawer assembly, according to some aspects of the disclosure. As shown in FIG. 4A, mini-drawer assembly 104 includes body-cover 318 that covers mini-drawer body 308 on the sides. As shown in FIG. 4A, mini-drawer assembly 104 includes base-cover 418 that covers at least a portion of body bottom 312. Mini-drawer body 308 that is shown in FIG. 3A, is coupled to sliding tab 306 and may slide along with body-cover 318 and base-cover 418 over sliding tab 306. Mini-drawer assembly 104 also includes sliding tab 306 and control device compartment 302 that is coupled to a rear end of sliding tab 306. Control device compartment 302 may include actuator 404. In some embodiments, control device compartment 302 may include a control device and the actuator. The control device is described with respect to FIG. 8. Mini-drawer assembly 104 may further include activation lever 408 and position sensor 410 that are coupled to a front side of sliding tab 306. Trigger arm 406 may be coupled between actuator 404 and activation lever 408 and actuator 404 may control a position of activation lever 408 between a raised position and a depressed position using trigger arm 406. As described, body-cover 318 and base-cover 418 may prevent or restrict a user from tampering with the latches to open lids 108 of compartments 106.

In some examples, actuator 404 may pull trigger arm 406 to rotate activation lever 408 and place the activation lever in the depressed position, e.g., to place activation lever 408 in a flat position parallel with sliding tab 306. In some examples, actuator 404 may push trigger arm 406 to rotate activation lever 408 and place the activation lever in the raised position. Conversely, in some examples, actuator 404 may place the activation lever in the raised position by pulling the trigger arm and may place activation lever 408 in the depressed position by pushing trigger arm 406. In some embodiments, a control device in control device compartment 302 may be coupled between a processor of drawer assembly 100 and actuator 404 and may receive commands from the processor to pull or push trigger arm 406.

In some examples, actuator 404 may pull trigger arm 406 to put activation lever 408 in the raised position, e.g., to put activation lever 408 in a slanted position. Activation lever 408 in the raised position may cause the activation lever to engage with a latch of compartment 106 to release lid 108 of compartment 106. The latch of compartment 106 is described with respect to FIGS. 5A-5B. In some embodiments, control device compartment 302 includes release nub 402. Release nub 402 may allow a user of the automated dispensing cabinet to manually unlock the mini-drawer assembly 104 (e.g., in case of power failure). After manually unlocking the mini-drawer, the user may pull it outward such that each one of lids 108 will unlatch and each one of compartments 106 will become accessible for item retrieval.

In some embodiments, mini-drawer assembly 104 includes a locking mechanism to lock, e.g., hold, mini-drawer assembly 104 inside drawer assembly 100. In some embodiments, the locking mechanism includes pocket 412A that is coupled to body bottom 312 close to body front 314. When mini-drawer assembly 104 is pushed by a user inside drawer assembly 100, pocket 412A may engage with activation lever 408 to lock mini-drawer assembly 104 inside drawer assembly 100. In some embodiments, pocket 412A may be coupled to a bottom 416 of a first compartment. In some embodiments, the control device and/or the processor may instruct actuator 404 to put activation lever 408 in a raised position when mini-drawer body 308 is pushed inside drawer assembly 100. The activation lever being in the raised position may cause activation lever 408 to engage with pocket 412A to lock the mini-drawer inside drawer assembly 100 and to keep spring 322, shown in FIG. 3B, in a contracted state. In some embodiments, the control device and/or the processor may instruct actuator 404 to put activation lever 408 in the depressed position to disengage from pocket 412A and to cause the mini-drawer to be unlocked. Unlocking the mini-drawer may release a pressure on spring 322 and may let mini-drawer assembly 104 to be opened and to be pushed out by a force caused by releasing the contracted spring. In some embodiments, the locking mechanism includes pocket 412A, activation lever 408, actuator 404, and trigger arm 406.

In some embodiments, a second pocket, pocket 412B, is coupled to body bottom 312 close to body rear 316. In some embodiments, pocket 412B may engage with activation lever 408 to keep mini-drawer body 308 from being removed from drawer assembly 100 when mini-drawer body 308 of mini-drawer assembly 104 is pulled all the way out of drawer assembly 100. In some embodiments, the control device and/or the processor may instruct actuator 404 to put activation lever 408 in the depressed position to disengage from pocket 412B and to allow the mini-drawer body 308 of mini-drawer assembly 104 to be removed from the drawer assembly 100.

Figure 4B:
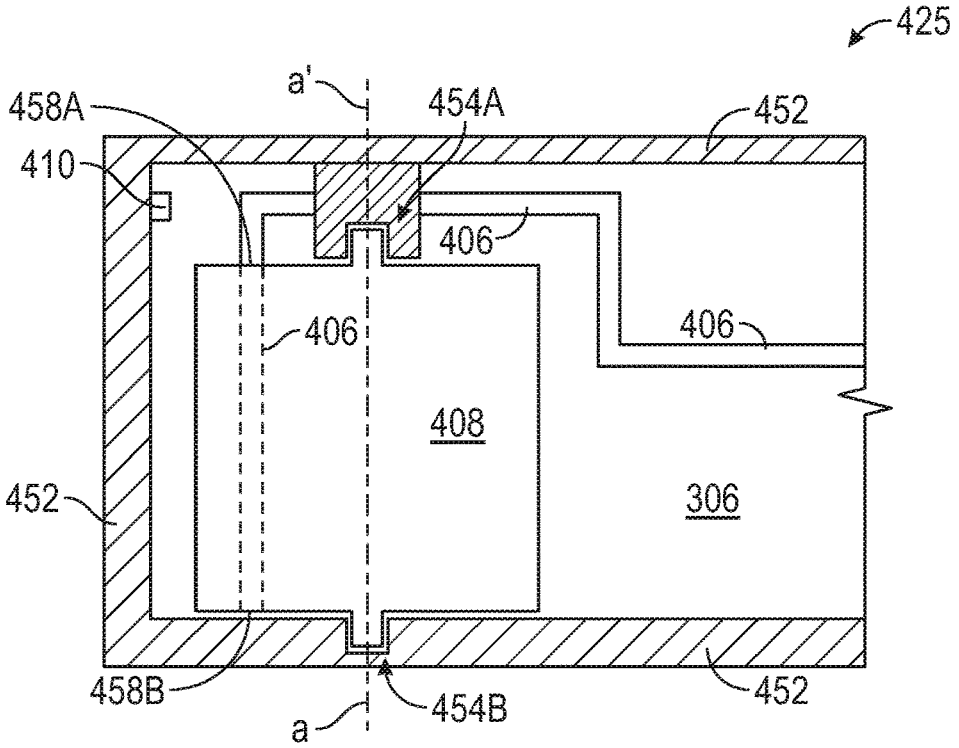
FIG. 4B illustrates a close up top view of an exemplary sliding tab of a mini-drawer assembly, according to some aspects of the disclosure.

FIG. 4B illustrates a close up top view of an exemplary sliding tab of a mini-drawer assembly, according to some aspects of the disclosure. As shown in FIG. 4B, diagram 425 includes sliding tab 306 having an edge layer 452. In some embodiments, edge layer 452 is slightly raised to enclose an inside of sliding tab 306. Diagram 425 includes activation lever 408 that is coupled to the edge layer via hinges 454A and 454B. Trigger arm 406 may be coupled to activation lever 408 between connection points 458A and 458B. In some embodiments, by pulling/pushing trigger arm 406, the activation lever may rotate around a-a' axis that pass through hinges 454A and 454B.

Figure 4C:
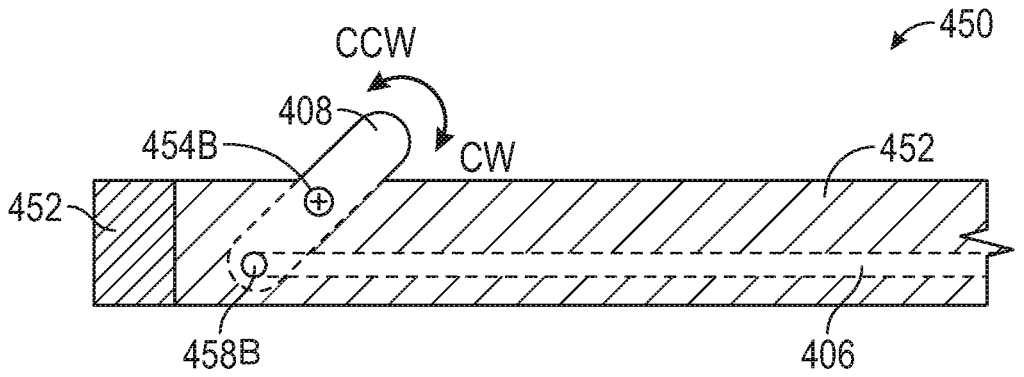
FIG. 4C illustrates a side view of an exemplary sliding tab of a mini-drawer assembly, according to some aspects of the disclosure.

FIG. 4C illustrates a side view of an exemplary sliding tab of a mini-drawer assembly, according to some aspects of the disclosure. As shown in FIG. 4C, diagram 450 includes edge layer 452 that is consistent with edge layer 452 of sliding tab 306 of the mini-drawer assembly shown in FIG. 4B. As described, edge layer 452 is slightly raised compared to the inside of sliding tab 306 and thus edge layer 452 may hide trigger arm 406 from view. As shown, activation lever 408 may be pulled via connection point 458B by trigger arm 406 to rotate activation lever 408 counter clockwise around hinge 454B to put activation lever 408 in the raised position. As shown, when activation lever is in the raised position, edge layer 452 may hide a portion of activation lever 408 from view. Conversely, activation lever 408 may be pushed via connection point 458B by trigger arm 406 to rotate activation lever 408 clockwise around hinge 454B to put activation lever 408 in the depressed position. When activation lever is in the depressed position, edge layer 452 may hide activation lever 408 from view.

Figure 4D:
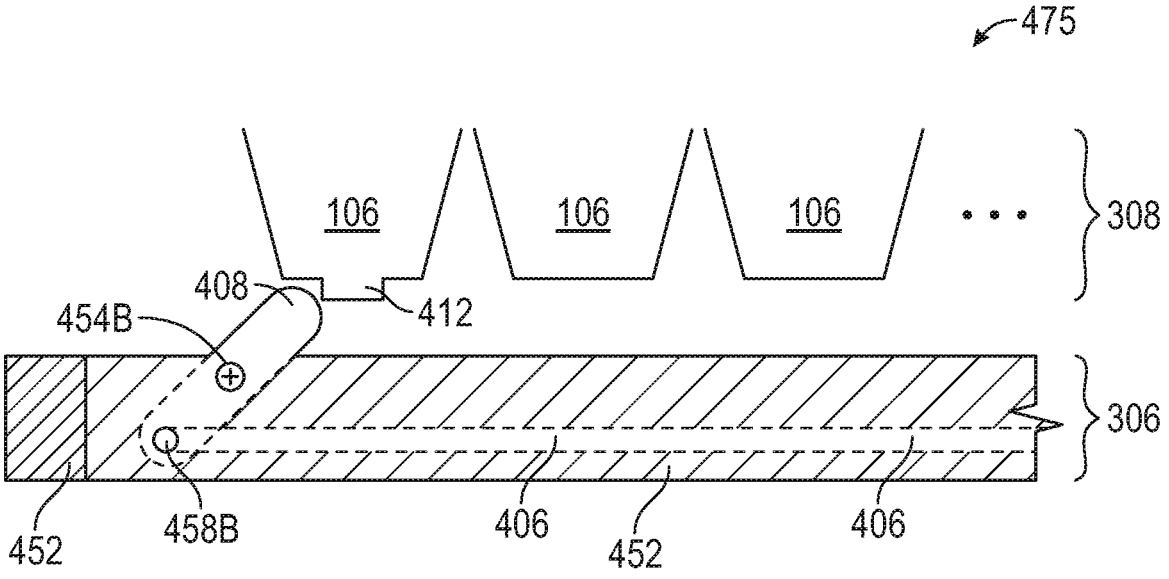
FIG. 4D illustrates a side view of an exemplary sliding tab of a mini-drawer assembly, according to some aspects of the disclosure.

FIG. 4D illustrates a side view of an exemplary sliding tab of a mini-drawer assembly, according to some aspects of the disclosure. As shown in FIG. 4D, diagram 475 includes the sliding tab of FIG. 4C with the activation lever 408 in the raised position. Diagram 475 additionally shows a portion of mini-drawer body 308 that includes compartments 106. As shown, the first compartment 106 includes pocket 412A that is coupled to bottom 416 of the first compartment as shown in FIG. 4A. In addition, as shown, activation lever 408 is engaged with pocket 412A to lock the mini-drawer assembly inside drawer assembly 100.

As shown in FIG. 4A, actuator 404, trigger arm 406, activation lever 408, position sensor 410, and control device compartment 302 may attach to sliding tab 306. In some embodiments, mini-drawer body 308 couples to edge layer 452 and moves with respect to sliding tab 306. In some embodiments, sliding tab 306 is attached to drawer assembly 100 of FIG. 1 and mini-drawer body 308 is pulled out of drawer assembly 100. In some examples, position sensor 410 is electrically coupled to the control device via trigger arm 406 and the control device of the mini-drawer assembly 104 receives position information of mini-drawer body 308. In some examples, the position information of mini-drawer body 308 includes an index number of the compartment of mini-drawer assembly that is passing over activation lever 408. In some embodiments, position sensor 410 is an optical sensor and determines the position information based on changing colors, e.g., changing reflections, of compartments passing over position sensor 410.

Figure 5A:
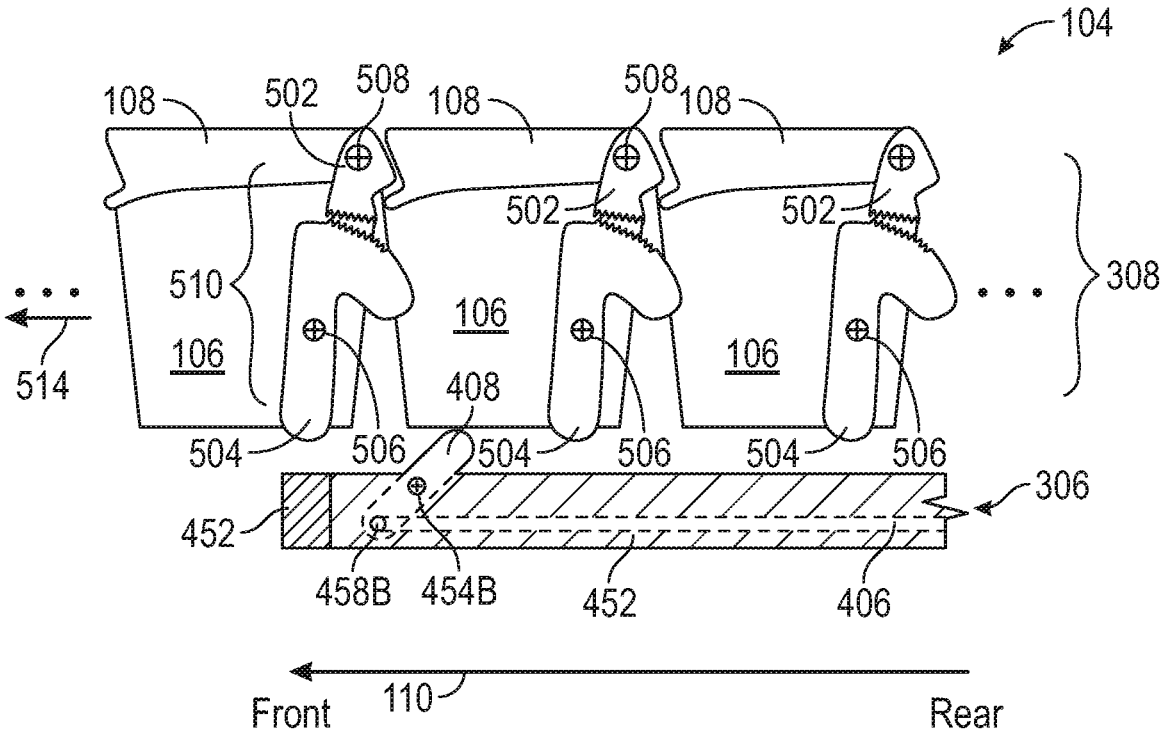
FIG. 5A illustrates a side view of an exemplary mini-drawer assembly, according to some aspects of the disclosure.

FIG. 5A illustrates a side view of an exemplary mini-drawer assembly, according to some aspects of the disclosure. As shown in FIG. 5A, mini-drawer assembly 104 includes sliding tab 306 and mini-drawer body 308 attached to sliding tab 306. Mini-drawer assembly 104 includes the sliding tab of FIG. 4C with the activation lever 408 in the raised position. Mini-drawer body 308 comprises compartments 106 where compartments 106 have lids 108 that may be closed, e.g., may be latched. In some embodiments as shown in FIG. 5A, mini-drawer body 308 may be mounted on sliding tab 306, e.g., mounted on edge layer 452, and may slide along rear-to-front direction 110 on sliding tab 306. In some embodiments, mini-drawer assembly 104 includes a separate latch 510 coupled to each compartment 106. In some embodiments, latch 510 may be coupled to a side of mini-drawer body 308 and activation lever 408 may also be coupled to a same side of sliding tab 306. When activation lever 408 is in the raised position and when mini-drawer body 308 is sliding on sliding tab 306 to be pulled out, latch 510 may come into contact with activation lever 408. In some embodiments, latch 510 comprises first latch part 502 and second latch part 504. Second latch part 504 may come into contact with activation lever 408. Activation lever 408 may rotate second latch part 504 counter clockwise around hinge 506 and second latch part 504 may in turn rotate first latch part 502 clockwise around hinge 508. In some embodiments, first latch part 502 is in contact with lid 108 of compartment 106 and holds lid 108 closed. Rotating first latch part 502 clockwise may push lid 108 and may cause first latch part 502 to release lid 108 and cause lid 108 to open.

FIG. 5A also shows forward direction 514, which is a direction that mini-drawer body 308 can be pulled out of drawer assembly 100. As shown, trigger arm 406 may be coupled to connection point 458B. By pulling trigger arm 406 opposite the forward direction 514, activation lever 408 may rotate around a-a' direction and move to the raised position. Conversely, by pushing trigger arm 406 to forward direction 514, activation lever 408 may be moved to the depressed position. In some embodiments, when activation lever 408 is in the raised position and when mini-drawer body 308 is sliding on sliding tab 306 in forward direction 514, latch 510 may come into contact with activation lever 408 and may cause lid 108 to be unlatched. In some embodiments, activation lever 408 returns to the depressed position, parallel with sliding tab 306, before mini-drawer body 308 of mini-drawer assembly 104 is pushed into drawer assembly 100.

Figure 5B:
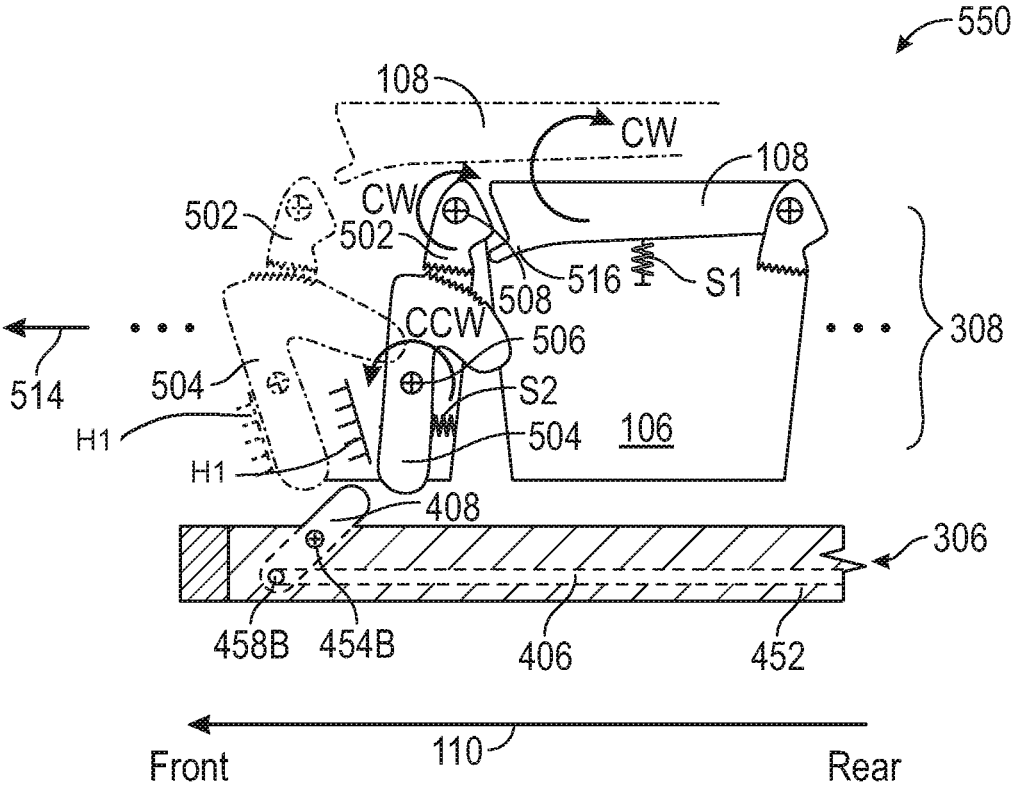
FIG. 5B illustrates a close-up side view of an exemplary release mechanism of a mini-drawer assembly, according to some aspects of the disclosure.

FIG. 5B illustrates a close-up side view of an exemplary release mechanism of a mini-drawer assembly, according to some aspects of the disclosure. As shown in diagram 550, mini-drawer assembly 104 includes first and second latch parts 502 and 504 of latch 510 that is shown in FIG. 5A. In some embodiments, when activation lever 408 of the release mechanism is in the raised position and mini-drawer body 308 is pulled in forward direction 514, second latch part 504 may come into contact with activation lever 408. The activation lever 408 may push second latch part 504 to cause second latch part 504 to rotate counterclockwise (CCW) around hinge 506. Causing second latch part 504 to rotate counterclockwise may make first latch part 502 rotate clockwise (CW) around hinge 508. Causing first latch part 502 to rotate clockwise may force first latch part 502 to clear fastening element 516 of lid 108 to release lid 108. Thus, when activation lever 408 is in the raised position, pulling mini-drawer body 308 in the forward direction 514 may cause lid 108 of a compartment passing over activation lever 408 to be unlatched. As shown in diagram 550, second latch part 504 may be rotated counter clockwise and first latch part 502 may be rotated clockwise (rotation not shown) by essentially a same amount.

As shown in diagram 550, solid lines show first latch part 502, second latch part 504, and lid 108 when lid 108 is closed. When lid 108 is closed, spring S1 is depressed and thus is under pressure, and spring S2 neither is under pressure nor pulled. Diagram 550 also shows hard stop H1 that may be used to limit the counter clockwise rotation of second latch part 504. Additionally, diagram 550 shows, in dashed lines, hard stop H1, first latch part 502, second latch part 504, and lid 108 when lid 108 is opened. After the lid is opened, spring S1 is released. Releasing S1 may push lid 108 to go up. After the lid is opened, spring S2 may be pulled and second latch part 504 may be stopped by hitting hard stop H1. As discussed, when activation lever 408 is in the raised position, pulling mini-drawer body 308 in the forward direction 514 may cause a compartment passing over activation lever 408 to be unlatched. In some embodiments, after the compartment passes and clears the activation lever 408, spring S2 may bring first latch part 502 and second latch part 504 back to a position shown in FIG. 5A.

Figure 6:
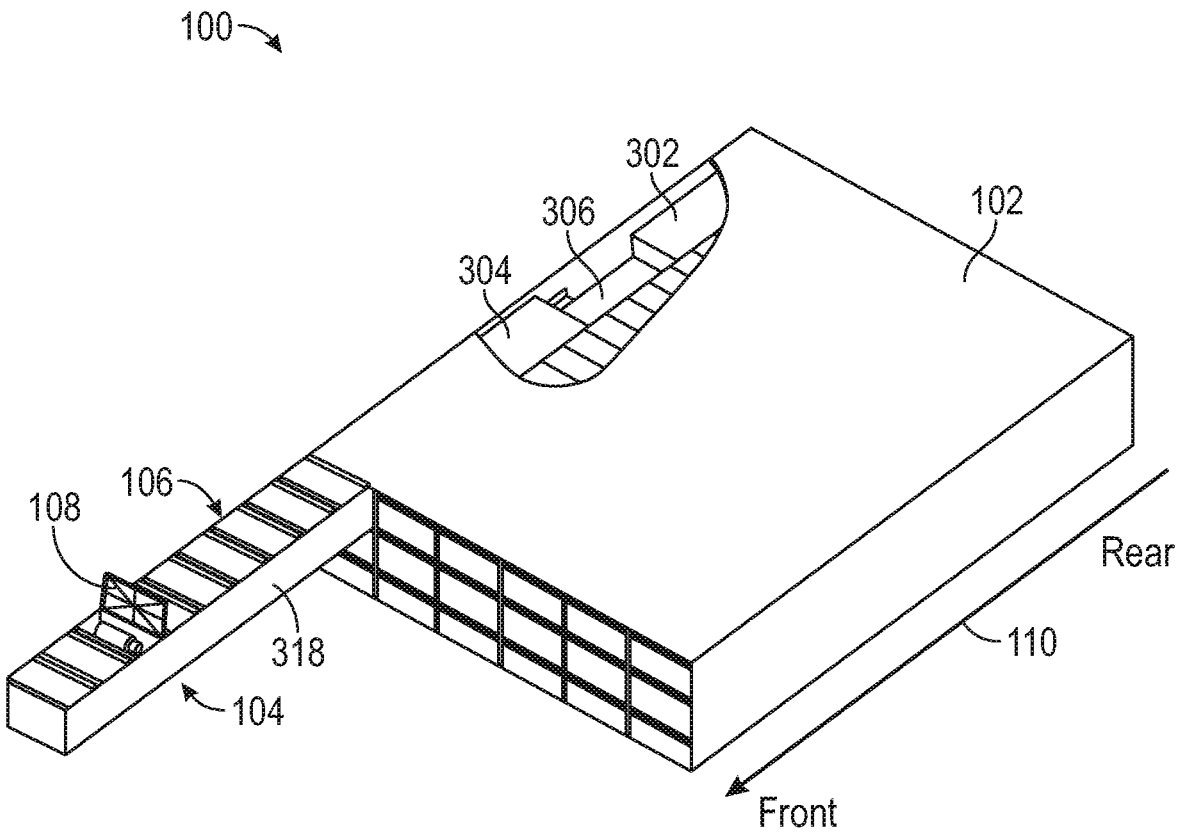
FIG. 6 illustrates an exemplary mini-drawer assembly, according to some aspects of the disclosure.

FIG. 6 illustrates an exemplary drawer assembly, according to some aspects of the disclosure. As shown in FIG. 6, drawer body 102 of drawer assembly 100 is partially exposed to show that one mini-drawer assembly 104 is partially pulled out. By pulling mini-drawer assembly 104 out in forward direction 514 as shown in FIG. 5A, mini-drawer body along with body-cover 318 and base-cover 418 is moved on sliding tab 306 and cushion compartment 304 is moved away from control device compartment 302. As discussed, sliding tab 306 may be fixed relative to drawer body 102. Thus, actuator 404, trigger arm 406, activation lever 408, position sensor 410, and control device compartment 302 that are coupled to sliding tab 306 may remain stationary with respect to drawer body 102 and may remain inside drawer body 102.

In some examples, when the third compartment is passing above activation lever 408, a control device in control device compartment 302 may command actuator 404 to push trigger arm 406 to put activation lever 408 in the raised position. The activation lever 408 being in the raised position, when third compartment 106 is passing above activation lever 408, may cause lid 108 of third compartment 106 to be unlatched. The control device may cause the activation lever to be kept in depressed position when the first and second compartments are passing above activation lever 408 and thus, as shown in FIG. 6, the first and second compartments are not unlatched. Also, the control device may cause activation lever 408 to return to the depressed position after the third compartment has passed above activation lever 408. In some examples, when a user retrieves an item from a compartment, lid 108 of the compartment is pressed to be latched and mini-drawer body 308 may be pushed back to the mini-drawer assembly 104 to be locked.

Figure 7:
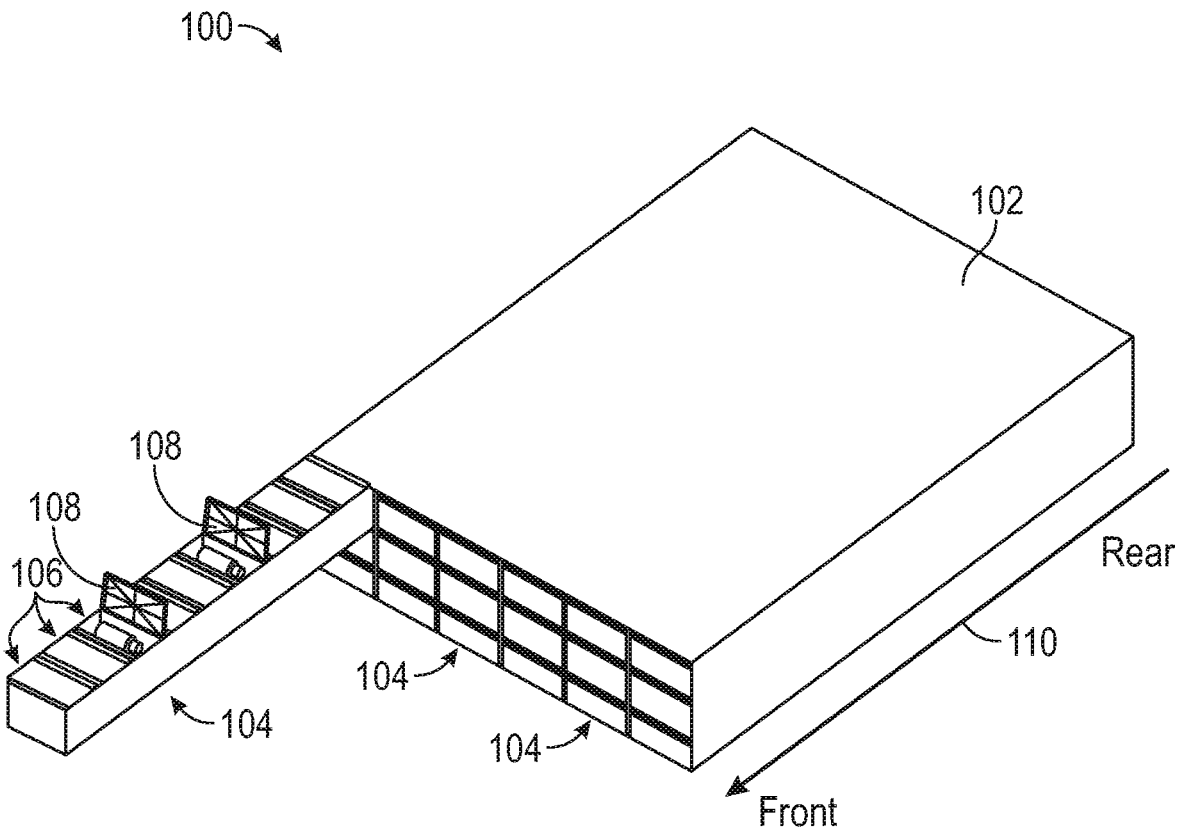
FIG. 7 illustrates an exemplary mini-drawer assembly, according to some aspects of the disclosure.

FIG. 7 illustrates an exemplary drawer assembly, according to some aspects of the disclosure. As shown in FIG. 7, one mini-drawer assembly 104 is partially pulled out. By pulling mini-drawer assembly 104 out in forward direction 514 as shown in FIG. 5A, mini-drawer body 308 is moved on sliding tab 306. In some examples, when the third and the sixth compartments are passing above activation lever 408, a control device in control device compartment 302 may command actuator 404 to push trigger arm 406 to put activation lever 408 in the raised position. Activation lever 408 being in the raised position, when third and sixth compartments 106 are passing above activation lever 408, may cause lid 108 of third and sixth compartments 106 to be unlatched. The control device may cause activation lever 408 to be kept in depressed position when the first and second compartments are passing above activation lever 408. Also, the control device may cause activation lever 408 to return to the depressed position when the fourth and fifth compartments are passing above activation lever 408. Thus, as shown in FIG. 7, the first, second, fourth, and fifth compartments are not unlatched. Additionally, the control device may cause activation lever 408 to return to the depressed position after the sixth compartment has passed above activation lever 408 so the other compartments remain latched.

In some examples, a caregiver may request two or more items that may be located in a single mini-drawer. Thus, when the mini-drawer is opened and pulled out, the lids of two or more compartments may be opened to provide the requested items. In some examples, a caregiver may request two or more items that may be located in two or more mini-drawers. Thus, the control system may open the two or more mini-drawers sequentially such that after retrieving an item from a first mini-drawer and closing the first mini-drawer, the next mini-drawer may be opened.

Figure 8:
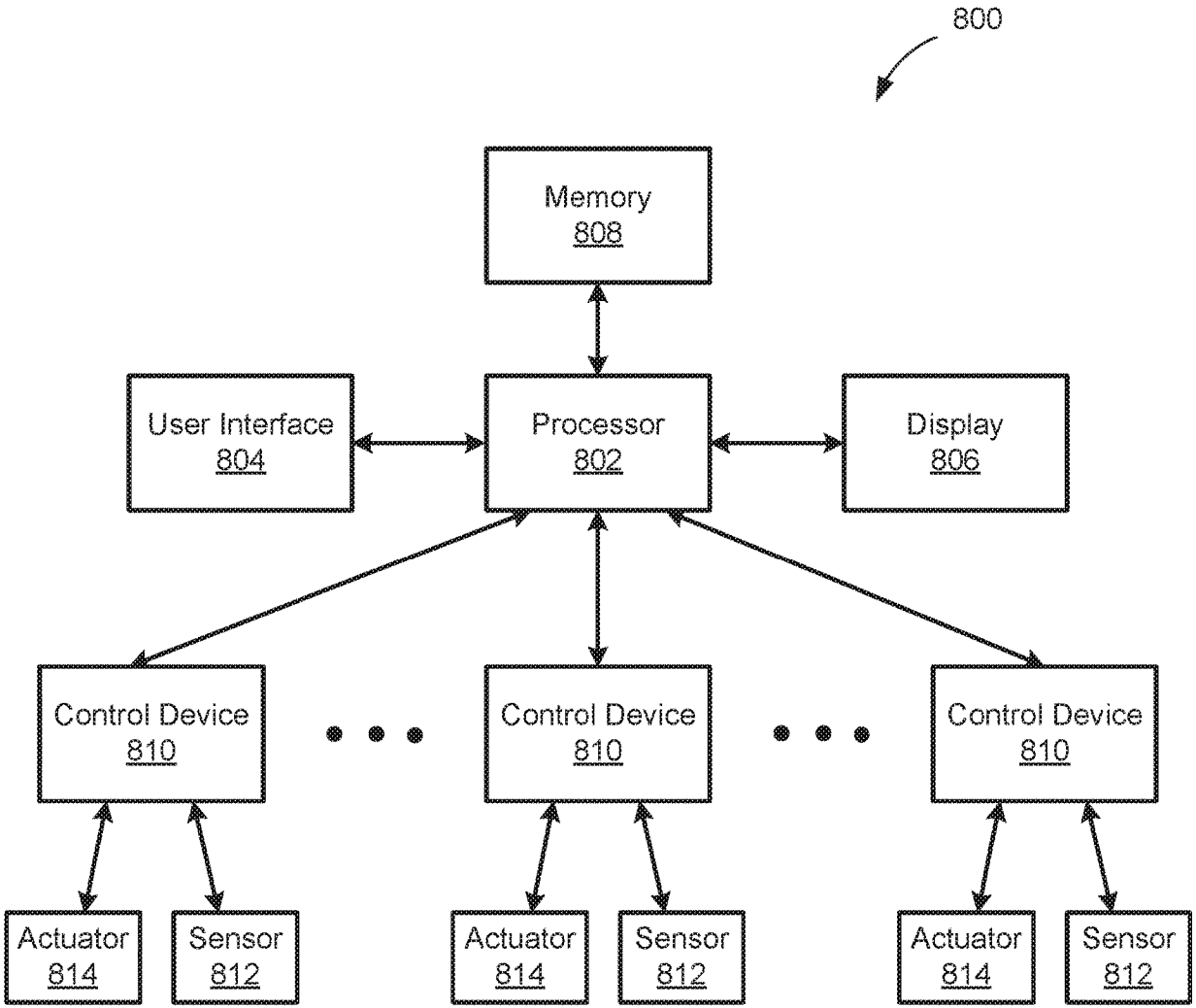
FIG. 8 illustrates a control system of an exemplary automated dispensing cabinet, according to some aspects of the disclosure.

FIG. 8 illustrates a control system of an exemplary automated dispensing cabinet, according to some aspects of the disclosure. As shown in FIG. 8, control system 800 includes one or more processors 802, user interface 804, display unit 806, and memory 808. In some embodiments, control system 800 may be included in top section 204 of FIG. 2. User interface 804 may include a touchscreen display, a mouse, a light pen, and a keyboard. The keyboard may be consistent with keyboard 208 of FIG. 2. Control system 800 further includes control devices 810. Each control device 810 may be associated with a separate mini-drawer and may be included in control device compartment 302 as shown in FIGS. 3A-3B. Control device 810 may couple to processor 802 and may communicate with processor 802 to receive instructions, e.g., commands, from processor 802. Control device 810 of each mini-drawer may be coupled to actuator 814 and sensor 812 that are consistent with actuator 404 and position sensor 410 of FIG. 4A. In some embodiments, control device 810 may receive information from sensor 812. In some examples, based on the information from sensor 812 and/or based on instructions from processor 802, control device 810 may command actuator 814 to pull or push a trigger arm such as trigger arm 406 of FIG. 4A-4B. The trigger arm may cause activation lever 408 to unlatch a compartment. In some embodiments, processor 802 is directly coupled to actuators 814 and control devices 810 are applications executing on processor 802. Then, the processor sends the commands to the actuators.

In some examples, the information of the stored items of automated dispensing cabinet 200 is kept in memory 808. The information of the stored items may be updated each time an item is stored in the automatic dispensing cabinet and each time an item is retrieved from the automated dispensing cabinet. In some examples, a user of automated dispensing cabinet 200 may request an item from automated dispensing cabinet 200 through user interface 804. The request may be processed by the processor 802. Processor 802 may determine, based on the information of the stored items in memory 808, where the requested item is located inside the automated dispensing cabinet. Processor 802 (e.g., an application executing on processor 802) may determine a requested drawer information of automated dispensing cabinet that includes the requested item. Processor 802 may further determine a requested mini-drawer information inside the requested drawer that includes the requested item. Processor 802 may also determine a requested compartment information inside the requested mini-drawer that has the requested item. In some embodiments, processor 802 transmits a signal to control device 810 of the requested mini-drawer. The transmitted signal may include the requested compartment information that has the requested item. In response to receiving the requested compartment information by control device 810 of the mini-drawer, the control device unlocks the requested mini-drawer. The unlocking may release a spring of the mini-drawer and may push out the requested mini-drawer. The pushing out of the mini-drawer after being released may indicate to the user which one of the mini doors includes the requested item and should be pulled out to retrieve the requested item.

In some embodiments, the compartments of the mini-drawer may be rearranged with an ordered index number. In some examples, the first compartment is a compartment closest to the front of the mini-drawer. The index numbers of the compartments may increase sequentially as the compartment is in a location further away from the front. Therefore, compartments of each mini-drawer may be assigned an index number and the location of each compartment corresponding to each index number may be known to control device. 810.

As described with respect to FIGS. 4A-4B, sliding tab 306 of each mini-drawer may include position sensor 410 that is consistent with sensor 812 of control system 800. As shown in FIG. 8, sensor 812 of each mini-drawer may be coupled to control device 810 of the mini-drawer and a signal detected by sensor 812 may be sent to control device 810. In some examples, the sensor receives a command from control device 810 to start and/or end detecting signals, e.g., electromagnetic and/or optical signals. In some examples, the sensor receives a command from control device 810 to send detected signals to the control device. When a user of automated dispensing cabinet 200 pulls mini-drawer body 308 of mini-drawer assembly 104, mini-drawer body 308 moves over, or relative to, sliding tab 306 and moves over, or relative to, the sensor. The movement of mini-drawer body 308 over sliding tab 306 may cause compartments 106 of mini-drawer body 308 to move over, or relative to, sensor 812. In some examples, sensor 812 detects signals received from a compartment moving over, or relative to, the sensor and may determine, based on the received signal, an index number of the compartment moving over, or relative to, the sensor.

In some embodiments, an activation lever consistent with activation lever 408 is positioned in a predefined distance and in a predefined direction from sensor 812. Thus, by determining the index number of the compartment moving over sensor 812, control device 810 may also know an index number of the compartment moving over the activation lever. Based on the index number of the compartment over the activation lever, control device 810 may determine when the requested compartment is over the activation lever. As discussed, control device 810 may command the actuator 814 that is consistent with actuator 404 of FIGS. 4A-4B, to the raised position to cause the requested compartment to unlatch. Thus, as the mini-drawer is pulled out and when the requested compartment reaches the activation lever, control device 810 may command the activation lever to cause the requested compartment to be unlatched.

In some embodiments, automated dispensing cabinet 200 may include a single control device 810 and may control the plurality of mini-drawer assemblies 104 of the automated dispensing cabinet using the single control device 810. In some examples, the sensor is an optical sensor that may receive an optical signal, e.g., may receive the reflective light from the compartments. In some embodiments, a surface of each compartment facing the sensor may have a different color, e.g., alternating colors, and the reflected optical signal received by the sensor may change each time a different compartment moves over the sensor. In some embodiments, each sensor 812 may directly couple to processor 802 and may send detected signals by the sensor to the processor. Similarly, each actuator 814 may directly couple to processor 802 and may directly receive commands from the processor. In some embodiments, an application executing on processor 802 may function as the control devices of the mini-drawers.

Figure 9:
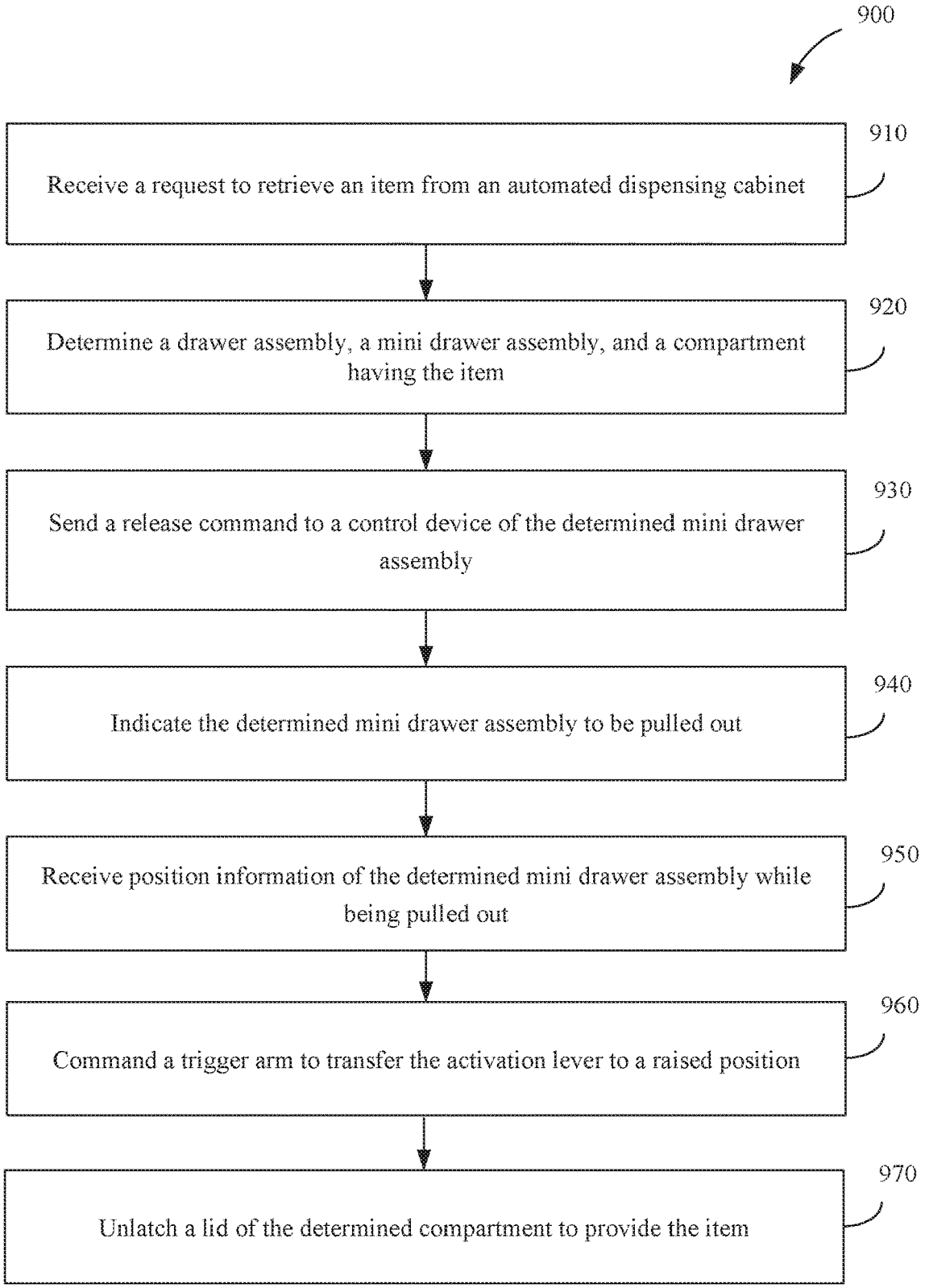
FIG. 9 illustrates a flow diagram of an example process of using a drawer assembly, according to some aspects of the disclosure.

FIG. 9 illustrates a flow diagram of an example process of retrieving an item from an automated dispensing cabinet. Notably, one or more steps of process 900 described herein may be omitted, performed in a different sequence, and/or combined with other processes for various types of applications contemplated herein. Process 900 can be performed by control system 800 of FIG. 8 to retrieve an item from automated dispensing cabinet 200 of FIG. 2.

The process 900 begins at step 910, where a request to retrieve an item from an automated dispensing cabinet is received. The request may be received by a user interface. The request may be received by typing an item name or number using a keyboard of top section 204 of automated dispensing cabinet 200 of FIG. 2. The request may be received by selecting an item on display 206 of top section 204 of automated dispensing cabinet 200 using a touch-screen display, a mouse or a light pen. The request may be transferred by the user interface to a processor of a control system of automated dispensing cabinet 200, e.g., processor 802 of control system 800. The processor may check the request against a database of items that are stored in a memory, e.g., memory 808, of control system 800 of automated dispensing cabinet 200 to validate the request.

In step 920, a drawer assembly, a mini-drawer assembly, and a compartment having the item are determined. After validating the request, the processor of the control system may determine a drawer assembly that includes the requested item. Then the processor may determine one of the mini-drawer assemblies of the drawer assembly that includes the requested item. Finally, the processor may determine the compartment in the mini-drawer assembly that includes the item. In some examples, the determined drawer assembly, the determined mini-drawer assembly, and the determined compartment is collectively called a location-in-cabinet. In some examples, the requested item is a dose of a medication, and automated dispensing cabinet 200 may have stored multiple doses of the same medication in different drawer assemblies, mini-drawer assemblies, and compartments. Thus, the processor may determine the location-in-cabinet based on a criterion such as an earliest expiration date of the medication. In some examples, the processor determines the location-in-cabinet based on expiration date and ease of access.

In step 930, a release command is sent to a control device of the determined mini-drawer assembly. In some embodiments, after determining the location-in-cabinet, the processor transmits a command to a control device associated with the determined mini-drawer assembly. The command instructs the control device to open (unlock) the determined mini-drawer assembly. In some examples, control system 800 may comprise a control device for each mini-drawer assembly. The control device may control latching and unlatching of the compartments and locking and unlocking of the mini-drawer assembly. In some examples, the control system may comprise a single control device for each drawer assembly. The single control device of each drawer assembly may control the plurality of the mini-drawer assemblies of the drawer assembly.

In step 940, the determined mini-drawer assembly to be pulled out is indicated. In some embodiments, after determining the drawer assembly and the mini-drawer assembly, the mini-drawer assembly is unlocked. The unlocking may release a spring of the mini-drawer assembly and may push forward the mini-drawer assembly. In some examples, releasing the spring of the mini-drawer assembly may indicate a location of the mini-drawer assembly to a user of automated dispensing cabinet 200.

In step 950, while being pulled out, position information of the determined mini-drawer assembly is received. In some embodiments, control device 810 of the mini-drawer assembly receives a position information of the mini-drawer assembly. The position information may correspond to position information of mini-drawer body 308 and may include a compartment number of mini-drawer body that is passing over activation lever 408.

In step 960, a trigger arm is commanded to transfer an activation lever to a raised position. In some examples, in response to determining that the determined compartment matches the position information, the control device may command the trigger arm to transfer the activation lever to the raised position. In some examples, the determined compartment matching the position information indicates that the determined compartment is passing over the activation lever. Therefore, the activation lever should be pushed to the raised position to engage the latch of the determined compartment. In some examples, the control device may command the actuator 404 to push trigger arm 406 to move activation lever 408 to the raised position.

In step 970, a lid of the determined compartment is unlatched to provide the item. As described, after pushing activation lever 408 to the raised position, the activation lever may engage the latch of the compartment passing above activation lever 408 and may unlatch lid 108 of the compartment. In some embodiments and as shown in FIG. 4, activation lever 408 that is attached to sliding tab 306 is located inside but close to a front side of sliding tab 306 and thus lid 108 of the determined compartment is unlatched when the determined compartment is about to exit the mini-drawer.

The present disclosure is provided to enable any person skilled in the art to practice the various aspects described herein. The disclosure provides various examples of the subject technology, and the subject technology is not limited to these examples. Various modifications to these aspects will be readily apparent to those skilled in the art, and the generic principles defined herein may be applied to other aspects.

A reference to an element in the singular is not intended to mean "one and only one" unless specifically so stated, but rather "one or more." Unless specifically stated otherwise, the term "some" refers to one or more. Pronouns in the masculine (e.g., his) include the feminine and neuter gender (e.g., her and its) and vice versa. Headings and subheadings, if any, are used for convenience only and do not limit the invention.

The word "exemplary" is used herein to mean "serving as an example or illustration." Any aspect or design described herein as "exemplary" is not necessarily to be construed as preferred or advantageous over other aspects or designs. In one aspect, various alternative configurations and operations described herein may be considered to be at least equivalent.

As used herein, the phrase "at least one of" preceding a series of items, with the term "or" to separate any of the items, modifies the list as a whole, rather than each item of the list. The phrase "at least one of" does not require selection of at least one item; rather, the phrase allows a meaning that includes at least one of any one of the items, and/or at least one of any combination of the items, and/or at least one of each of the items. By way of example, the phrase "at least one of A, B, or C" may refer to: only A, only B, or only C; or any combination of A, B, and C.

A phrase such as an "aspect" does not imply that such aspect is essential to the subject technology or that such aspect applies to all configurations of the subject technology. A disclosure relating to an aspect may apply to all configurations, or one or more configurations. An aspect may provide one or more examples. A phrase such as an aspect may refer to one or more aspects and vice versa. A phrase such as an "embodiment" does not imply that such embodiment is essential to the subject technology or that such embodiment applies to all configurations of the subject technology. A disclosure relating to an embodiment may apply to all embodiments, or one or more embodiments. An embodiment may provide one or more examples. A phrase such an embodiment may refer to one or more embodiments and vice versa. A phrase such as a "configuration" does not imply that such configuration is essential to the subject technology or that such configuration applies to all configurations of the subject technology. A disclosure relating to a configuration may apply to all configurations, or one or more configurations. A configuration may provide one or more examples. A phrase such as a configuration may refer to one or more configurations and vice versa.

In one aspect, unless otherwise stated, all measurements, values, ratings, positions, magnitudes, sizes, and other specifications that are set forth in this specification, including in the claims that follow, are approximate, not exact. In one aspect, they are intended to have a reasonable range that is consistent with the functions to which they relate and with what is customary in the art to which they pertain.

It is understood that the specific order or hierarchy of steps, operations, or processes disclosed is an illustration of exemplary approaches. Based upon design preferences, it is understood that the specific order or hierarchy of steps, operations, or processes may be rearranged. Some of the steps, operations, or processes may be performed simultaneously. Some or all of the steps, operations, or processes may be performed automatically, without the intervention of a user. The accompanying method claims, if any, present elements of the various steps, operations, or processes in a sample order, and are not meant to be limited to the specific order or hierarchy presented.

All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. § 112 (f) unless the element is expressly recited using the phrase "module for" or, in the case of a method claim, the element is recited using the phrase "step for." Furthermore, to the extent that the term "include," "have," or the like is used, such term is intended to be inclusive in a manner similar to the term "comprise" as "comprise" is interpreted when employed as a transitional word in a claim.

What is claimed is:

1. A drawer assembly comprising:

one or more mini-drawer assemblies, each mini-drawer assembly comprising:

a body, the body having a body top, a body bottom, a body rear, a body front, and a rear-to-front axis;

a sliding tab along the rear-to-front axis, wherein the body is coupled from the body bottom to the sliding tab and the body is configured to slide over the sliding tab;

a plurality of compartments in the body;

a plurality of lids hingedly coupled to the plurality of compartments on the body top, wherein each lid is configured to cover an opening of a corresponding compartment, and wherein each lid having a respective fastening element;

a plurality of latches coupled to the body, wherein each one of the plurality of latches is coupled to a corresponding compartment, wherein the plurality of latches are configured to hold the respective fastening element of the plurality of lids when in a first position and to release the respective fastening element when in a second position; and a release mechanism comprising an activation lever coupled to the sliding tab, the activation lever is configured to move between a raised position and a depressed position, wherein the activation lever in the raised position is configured to engage the latch of a compartment when the body is being pulled out along the rear-to-front axis, and to cause the latch to move to the second position to release the respective fastening element and to unlatch the lid of the compartment.

2. The drawer assembly of claim 1, further comprising:

a chassis, wherein the sliding tab of each one of the one or more mini-drawer assemblies is attached to the chassis, and wherein the body of a corresponding mini-drawer assembly is configured to slide over the attached sliding tab to move out of the chassis.

3. The drawer assembly of claim 2, wherein each mini-drawer assembly further comprises:

a first pocket coupled to the body bottom at the body front, wherein the body of the mini-drawer assembly is configured to slide over the attached sliding tab to move inside the chassis, and wherein the activation lever in the raised position is configured to engage with the first pocket to lock the body of the mini-drawer assembly inside the drawer assembly;

a second pocket coupled to the body bottom at the body rear, wherein when the body of the mini-drawer assembly is slid over the attached sliding tab to move outside the chassis, the activation lever in the raised position is configured to engage with the second pocket to restrict the body of the mini-drawer assembly from being removed from the chassis.

4. The drawer assembly of claim 1, wherein each mini-drawer assembly further comprises:

a control device compartment coupled to a rear end of the sliding tab and comprising an actuator; and the release mechanism further comprising a trigger arm coupled between the actuator and the activation lever, wherein the actuator is configured to move the activation lever between the raised position and the depressed position using the trigger arm.

5. The drawer assembly of claim 4, wherein each mini-drawer assembly further comprises a position sensor coupled to the sliding tab and configured to detect a first position information of the body with respect to the sliding tab.

6. The drawer assembly of claim 5, wherein each mini-drawer assembly further comprises:

a control device in the control device compartment and coupled to the actuator, the control device is configured to receive the first position information of the body with respect to the sliding tab and to determine a second position information of the plurality of compartments with respect to the activation lever of the sliding tab.

7. The drawer assembly of claim 6, wherein, based on the second position information, the control device is configured to translate the trigger arm via the actuator to move the activation lever to the raised position when a predetermined compartment is over the activation lever.

8. The drawer assembly of claim 1, further comprising:

a control system, wherein the control system comprises a processor and one or more control devices, each mini-drawer assembly is coupled to a control device, wherein the processor is configured to determine a designated mini-drawer assembly and a designated compartment of the designated mini-drawer assembly to be opened, and wherein the processor is configured to send a command to the control device of the designated mini-drawer assembly to:

unlock the designated mini-drawer assembly; and unlatch the designated compartment of the designated mini-drawer assembly after the designated mini-drawer assembly is opened and is pulled out.

9. The drawer assembly of claim 8, wherein the control system further comprises a memory and one or more user interfaces, wherein the processor is configured to determine the designated mini-drawer assembly and the designated compartment based on a user request for an item that is received through the one or more user interfaces, and wherein the processor is configured to determine the designated mini-drawer assembly and the designated compartment based on data of stored items in the memory.

10. The drawer assembly of claim 8, wherein the processor is configured to determine a designated mini-drawer assembly and two or more designated compartments of the designated mini-drawer assembly to be opened, and wherein the processor is configured to send a command to the control device of the designated mini-drawer assembly to:

unlock the designated mini-drawer assembly; and unlatch the two or more designated compartments of the designated mini-drawer assembly after the designated mini-drawer assembly is opened and is pulled out.

11. The drawer assembly of claim 1, wherein the activation lever in the depressed position is configured not to engage the latch of a compartment.

* * * * *